US005988404A

United States Patent [19]

Wilen

[11] Patent Number: 5,988,404

[45] Date of Patent: Nov. 23, 1999

[54] PORTABLE TELEVISION CHANNEL SELECTION STATION WITH GUIDEBOOK ATTACHMENT SLITS

[76] Inventor: Richard Wilen, 135 Oval Dr., Islandia, N.Y. 11722

[21] Appl. No.: 08/825,929

[22] Filed: Apr. 7, 1997

[51] Int. Cl.[6] ..... A47F 7/00

[52] U.S. Cl. ..... 211/26.1; 211/42; 281/15.1; 248/205.2

[58] Field of Search ..... 211/13.1, 26.1, 211/45, 42; 248/205.2; 281/15.1

[56] References Cited

U.S. PATENT DOCUMENTS

| | | | |
|---|---|---|---|
| 4,610,054 | 9/1986 | Malian | 248/205.2 X |
| 4,991,817 | 2/1991 | Vonkleist et al. | 248/205.2 X |
| 5,042,670 | 8/1991 | Timberlake | 211/13.1 |
| 5,082,229 | 1/1992 | Dahl | 248/205.2 X |
| 5,269,484 | 12/1993 | Jones | 248/205.2 X |
| 5,348,347 | 9/1994 | Shink | 281/15.1 X |
| 5,647,486 | 7/1997 | Wilen | 211/26.1 |

*Primary Examiner*—Robert W. Gibson, Jr.
*Attorney, Agent, or Firm*—Stephen E. Feldman

[57] ABSTRACT

The invention provides a generally rectangular planar television channel selection station which comprises an arrangement of three parallel slits for fixing a program schedule guide thereto. These first, second and third slits are generally parallel to, and substantially adjacent to, a first side of the station. The first slit is substantially slightly longer in length than the folded side of a program guide schedule and is spaced the nearest of the three slits to the first side. The third slit is spaced the furthest from the first side. The spacing between the first second and third slits is sufficient to enable the program schedule guide to be fixed to the station when the last page of it is folded to substantially form a triangle having a base attached to the folded side of the program guide schedule and an apex opposite the base; and the triangle is threaded, the apex first, through the first slit; then through the third slit; and, finally through the second slit. Optionally the second slit is wider in the middle of it, in the direction of the first slit, so as to facilitate the final threading of the apex through the second slit. The station also includes a velcro strip for attaching a remote control to it and, indicia for indicating the respective name, call letters and numbers of at least one television station printed on it. The station can be constructed of any common material or combination of materials including but not limited to: fiberboard, cardboard, plastic, wood and plywood. Optionally it can also include printed advertisement indicia.

10 Claims, 1 Drawing Sheet

PORTABLE TELEVISION CHANNEL SELECTION STATION WITH GUIDEBOOK ATTACHMENT SLITS

BACKGROUND OF THE INVENTION

This invention relates to aids and apparatus for television channel selection and has particular utility for use as an aid to the viewer having a television receiver having a large number of available television channels.

In its broadest embodiment, the invention contemplates a compact portable station which ensures the proximity of a remote control device (hereinafter "RC") to a television program schedule guide. Specifically, the instant invention provides a novel arrangement for substantially fixing a television program schedule guide to portable television channel selection station.

In recent years, remote-controllable entertainment and other electronic appliances, such as televisions, video cassette recorders ("VCR's"), audio receivers, etc., have proliferated. Each of these appliances can be controlled (i.e., turned on and off, programmed, tuned, and the like) by a remote-controlled (RC) device, which usually is a small box with an infra-red transmitter inside and various switches on a top surface of it, for controlling the transmitter and causing it to transmit selected codes to the appliance.

The users of such appliances, usually keep their RC units on a low table in front of a sofa, on an arm of a sofa, on a bedside night table, etc. However, as is the usual case, when a user owns several appliances which employ an RC unit, the viewer must store each respective RC unit in a place and manner so as not to cause confusion between it and RC units for other appliances which the viewer might have. Storage of several RC units in any of the aforementioned places, thus presents a problem since the respective, individual RC units tend to become confused among the others and/or lost under other equipment, sofa cushions, books, papers, and the like.

In addition to this problem, users of such RC units typically keep a schedule of entertainment programs and other reference materials, such as television guidebooks, cable guidebooks, satellite television guidebooks, and the like, in proximity to their respective RC units. Thus, the problem presented by the storage and retrieval of these printed materials tends to compound the posed by plural RC units.

Various schemes have been proposed to secure a RC to a fixed position to provide certainty of access to it by a viewer.

In U.S. Pat. No. 5,485,359 to Galvin, a remote control holder and illumination device, for a remote control having a keypad has a base, an illumination member and a mirror housing adjustment member. The base has a guide passage therein. A fastening member is attached to the upper surface of the base to fasten the base to the remote control. The illumination member has a support frame slidingly attached to the base. A mirror housing is connected to the support frame. A convex mirror is attached to the mirror housing. The mirror may be curved in a convex or concave manner. A mirror housing adjustment member has a guide tab, connected to the support frame, that traverses the guide passage. An actuation member extends through the guide passage to allow the user to adjust the position of the mirror housing along the length of the base.

In U.S. Pat. No. 4,815,683 to Ferrante, a holder for TV/VCR remote control unit is generally rectangular and has one or two remote control unit receiving compartments. Variously shaped spacer brackets can be used to attach the holder to a support surface such as the housing of a TV or VCR. Advantageously, resilient members, such as springs or foam pads are placed into the receiving compartments to selectively elevating the remote control units above the holder to facilitate gripping and provide protection to the units against mechanical shock.

In U.S. Pat. No. 4,848,609 to Meghnot, an adjustable device for holding together any two remote television (TV), stereo and video cassette recorder (VCR) monitor control units. The device consists of two interconnecting pieces having sides with gripping means for firmly holding the monitors in place, bottom portions which interconnect by tongue and groove means and upper portions having matching teeth and grooves for adjustably interconnecting the two pieces to hold any two sizes of controls. The device can be easily held in one hand, thereby leaving the other hand free to operate the TV, stereo and VCR remote control units at the same time. This device prevents remote control units from being misplaced and protects said units from damage due to dropping.

In U.S. Pat. No. 4,893,222 to Mintzer, an illumination device for use with a hand-held remote control unit comprising a base and a projection extending from the base and the projection is exposed to a space formed by the base and contains an illumination source which is directed toward the space. The space is configured to accommodate receipt of at least a portion of the hand-held remote control unit in the space so as to return the hand-held remote control unit in a position to subject a selected surface thereof to the illumination source for facilitating illumination thereof while permitting actuation and operation of the hand-held remote control unit.

In U.S. Pat. No. 4,852,746 to Wells, et al, a remote control unit orientation and storage device (18) includes four wall members (20A, 20B, 20C, and 20D) that define both a plurality of open cells (84A, 84B, 84C, and 84D) for selective engagement of remote control units (81A, 81B, 81C, and 81D) and an internal cell (86) in which accessories (92, 94) are storable. Fastener means (80) provided on wall members forming the cells facilitate secure mounting of remote control units within the cell, and also permit selective removal of remote control units.

In U.S. Pat. No. 4,856,658 to Novak, a holder assembly for remote control units used with television sets, recorders, stereos, home entertainment centers and the like and comprising an adjustably sized control unit holder adapted to be interconnected with other similarly constructed holders.

In U.S. Pat. No. 4,739,897 to Butler, a holder for a remote control unit is provided and consists of a floor panel disposed between and spanning a pair of spaced side panels, a front panel and a rear panel forming therebetween a remote control unit receiving compartment to receive and position the remote control unit. A lower compartment is formed beneath the floor panel so that batteries for the remote control unit can be stored within. A pair of holders can be secured together in a back-to-back relationship for holding two remote control units.

Other schemes have been proposed to secure both an RC and a television program schedule guide in a fixed location within the viewing area.

In U.S. Pat. No. 5,127,615 to Jones, a holder for accessories for electronic equipment, such as remote controls (RCs) (30) for televisions, VCRs, audio receivers, etc., and schedule or guidebooks (62) for such equipment comprises a cradle (56) of variable width and length for holding one or more RCs and an underlying holder (34) for the guidebook.

The cradle comprises a plurality of L-shaped members (10U, 10L, 80U, 80L) whose long portions (12, 82) overlap to form the bottom of the cradle and are clampable together in a range of positions, e.g., by means of screws (18) or hook-and-loop (H&L) fasteners (22) or double-stick sided tape. The short portions (14, 84) of the L-shaped members stand upright in a spaced relation to form the sides of the cradle. Plural shorter L-shaped members can be used with a provision for adjustable spacing so that the length of the cradle can also be adjusted. The RC units are positioned on the floor of the cradle, side-by-side, and may be held thereto by means of H&L fasteners (24). The underlying guidebook holder may be used alone or it may be attached to the RC-holding cradle by H&L fasteners (32, 54, 79), double-stick-sided tape, or integrally. Additional holders may be stacked below the first one. It comprises a plurality of plates (36, 37, 38) with attached sides so as to form a rectangular cavity. The bottom of the cavity may be closed by end flaps (42, 46, 68) of the plates or by a clamp (70) or a torsion spring. The plates may be hinged and held together by a coil or torsion spring (72) such that they can be opened in clamshell fashion.

In U.S. Pat. No. 4,739,887 to Beach, a rack is specially designed for holding stereo and television remote control devices. The rack includes horizontally adjustable shelves and may further include either a fixed or swivel base. The rack also includes a special holder for a television guide book or the like.

In addition to the problems cited above, none of the prior art schemes provides common portable television channel selection station by which the proximity of a given RC devise to a given program schedule guide may be ensured. Nor does any of the prior art schemes provide any means by which a program guide schedule might be easily fixed to such a portable television channel selection station.

SUMMARY OF THE INVENTION

The instant invention broadly provides an improvement to a portable television channel selection station. Specifically, the invention provides a novel arrangement to fix at least the last page of a television program schedule guide to a portable television channel selection station.

The invention provides a generally rectangular planar television channel selection station which comprises an arrangement of three parallel slits for fixing a program schedule guide thereto. These first, second and third slits are generally parallel to, and substantially adjacent to, a first side of the station. The first slit is substantially slightly longer in length than the folded side of a program guide schedule and is spaced the nearest of the three slits to the first side. The third slit is spaced the furthest from the first side. The spacing between the first, second and third slits is sufficient to enable the program schedule guide to be fixed to the station when the last page of it is folded to substantially form a triangle having a base attached to the folded side of the program guide schedule and an apex opposite the base; and the triangle is threaded, the apex first, through the first slit; then through the third slit; and, finally through the second slit. Optionally the second slit is wider in the middle of it, in the direction of the first slit, so as to facilitate the final threading of the apex through the second slit. The station also includes a velcro (e.g., a hook and loop-type fastener) strip for attaching a remote control to it and, indicia for indicating the respective name, call letters and numbers of at least one television station printed on it. The station can be constructed of any common material or combination of materials including but not limited to: fiberboard, cardboard, plastic, wood and plywood. Optionally it can also include printed advertisement indicia.

Accordingly, the invention provides various objects and advantages including a conspicuous easily locatable device storing and keeping at least One (1) RC unit in an organized, neat, and easily accessible manner. At the same time, the invention also provides a way to store and keep at least One (1) television program guide associated with such RC unit, in the same manner. Still further at the same time, a novel mode for substantially fixing at least One (1) television program guide to a readily conspicuous station which also embodies a arrangement for affixing an RC unit, is provided. Still further at the same time, a mode for presenting television channel call letters/channel number key is provided to the viewer. Still further at the same time, a mode for presenting advertising indicia to the viewer is provided.

The more important features of the invention have been broadly outlined above, in order that the detailed description that follows may be better understood; and in order for the present contribution to the art may be better appreciated. There are additional features of the invention that will be described hereinafter and which form the subject matter of the appended claims. Those of ordinary skill in the art will appreciate that the conception upon which this disclosure is based may readily be utilized as a basis for the designing of other structures, methods and systems for carrying out the several purposes of the instant invention. It is important, therefore, that the claims be regarded as including such equivalent constructions insofar as they do not depart from the spirit and scope of the instant invention.

Further, the purpose of the instant abstract is to enable the U.S. Patent and Trademark office and the public generally, and especially the scientists, engineers and practitioners in the art who are not familiar with patent or legal terms or phraseology, to determine quickly from a cursory inspection of it, the technical disclosure of the patent application. The abstract is neither intended to define the invention of the instant patent application, which is measured by the claims, nor is it intended in any manner to be limiting as to the scope of the instant invention.

It is an object of the instant invention to provide a portable television channel selection station which, although portable, is sufficiently conspicuous so as to not be easily misplaced, which has a novel arrangement for fixing a television program schedule guide to it.

It is a further object of the instant invention to provide a portable television channel selection station which can be used as a low cost advertisement promotional gift.

It is a further object of the instant invention to provide a portable television channel selection station which can be used as a low cost method of presenting a television viewer with printed advertisement indicia.

Other objects, features, and advantages of the instant invention, in its details of construction and arrangement of parts, will be seen from the above, from the following description of the preferred embodiment when considered in light of the drawings and the appended claims.

DETAILED DESCRIPTION OF THE INVENTION

Figure 1:
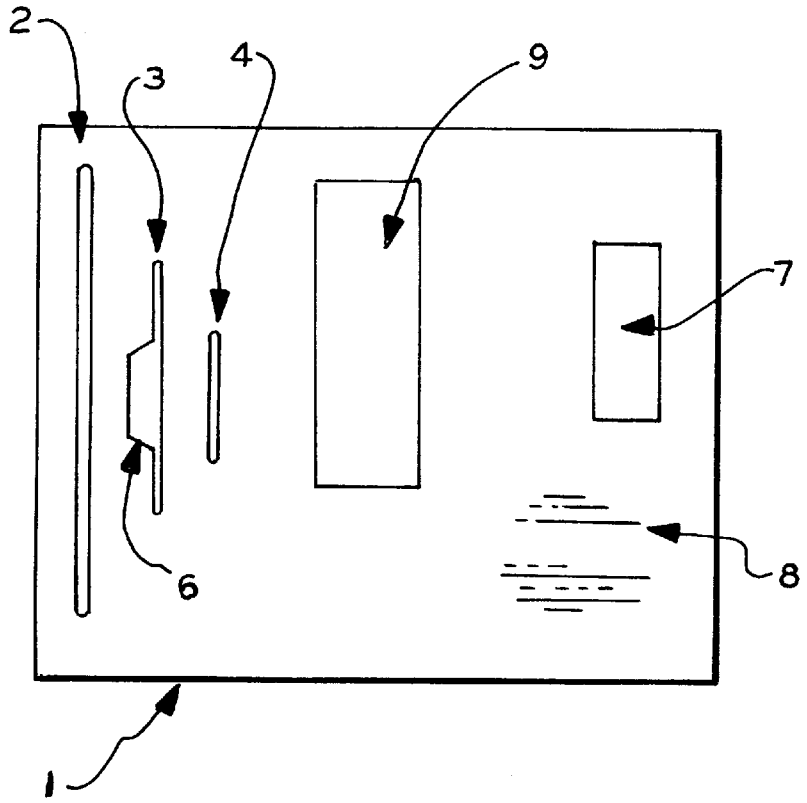
FIG. 1, shows the preferred embodiment of the invention without a program schedule guide attached.
Figure 2:
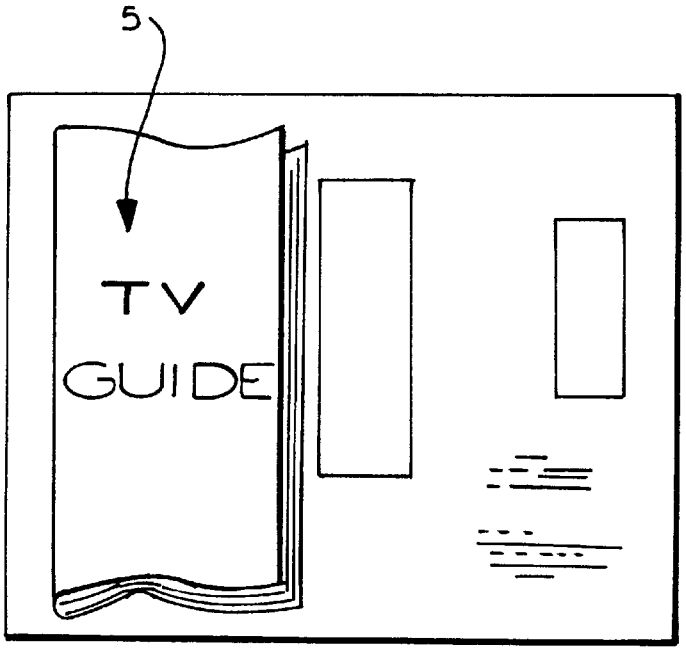
FIG. 2, shows the preferred embodiment of the invention with a program schedule guide attached.

As shown in FIG. 1, the invention provides a generally rectangular planar television channel selection station (1)

which comprises an arrangement of three parallel slits (2–4) for fixing a program schedule guide thereto. These first (2), second (3) and third (4) slits are generally parallel to, and substantially adjacent to, a first side of the station (1). The first slit (2) is substantially slightly longer in length than the folded side of a program guide schedule and is spaced the nearest of the three slits to the first side. The third slit (4) is spaced the furthest from the first side. As shown in FIG. 2, the spacing between the first (2), second (3) and third (4) slits is sufficient to enable the program schedule guide (5) to be fixed to the station (1) when the last page of it is folded to substantially form a triangle having a base attached to the folded side of the program guide schedule and an apex opposite the base; and the triangle is threaded, the apex first, through the first slit (2); then through the third slit (4); and, finally through the second slit (3). Optionally the second slit (3) is wider in the middle of it (6), in the direction of the first slit (2), so as to facilitate the final threading of the apex through the second slit. As shown in FIG. 1, the station (1) also includes a velcro strip (7) for attaching a remote control to it and, indicia (9) for indicating the respective name, call letters and numbers of at least one television station printed on it. The station (1) can be constructed of any common material or combination of materials including but not limited to: fiberboard, cardboard, plastic, wood and plywood. As shown in FIG. 1, the station (1) can also optionally include printed advertisement indicia (8).

FIG. 2 shows the station (1) after a program guide schedule has been threaded through the three parallel slits, explained above.

As previously noted the station can be constructed of any common material or combination of materials including but not limited to: fiberboard, cardboard, plastic, wood and plywood.

When cost is the controlling factor of consideration, heavy cardboard and fiberboard the preferred materials of construction.

The preferred process when constructing the station from heavy cardboard, fiberboard or plastic, is press stamping. Typically in such a process, a rotary printing press is provided with a blanket cylinder and an impression cylinder. The blanket is removed and replaced by a base sheet. Arranged strips are provided on this base sheet. The arrangement of the strips corresponds to the slit perforations or stamping to be produced in the paper, cardboard or fiberboard passing through the rotary printing press. A smooth protective sheet is arranged on the impression cylinder. Both sheets can be used several times and can be installed or removed rapidly by means present on the machine. After a station is produced in this manner it is thereafter finished by applying desired printed indicia by any conventional method. Decaled indicia is preferred when cost is the limiting consideration. Where cost is overridden by the desire for esthetics, silk-screening is preferred.

When cost is not a controlling factor of consideration, plastic, wood and plywood are the preferred materials of construction.

When a plastic material of construction is used, the preferred method of manufacture is hot stamp pressing. Typically in such a process, a blank is machined from the sheet of plastic to a predetermined precompensated size larger than desired to accommodate normalizing shrinkage. Typically, the blank is normalized by heating the blank in a vacuum oven. The vacuum is released from the oven by introducing dry nitrogen. A stamping die is provided. An embossing surface of the stamping die is contoured as a physical negative of the instant station and bears a physical negative of the desired surface structure of the station. The embossing surface of the stamping die is forced into engagement with the surface of the blank at a predetermined stamping pressure and for a predetermined stamping dwell time. Sufficient heat or ultrasonic energy is applied to the station generation area of the blank to provide the desired station. The embossing surface of the stamping die is removed from the station following the expiration of the stamping dwell time. The station is then removed and excess plastic is removed. As noted above, the desired printed indicia is thereafter applied by any conventional method. Decaled indicia is preferred when cost is the limiting consideration. Where cost is overridden by the desire for esthetics, silk-screening is preferred.

As an alternative but more expensive method of production for forming a somewhat more decorative station, when a plastic is selected as the material of construction, a method can be employed for producing a molded station in a predetermined spatial, non-laminate configuration. This method involves feeding the plurality of respectively dissimilar fluid components, mutually separated, into the molded article-forming structure, which contains a plate flow distributor and a non-fiber-forming shaping section. The flow distributor is made up of at least one distribution plate which is preferably thin and has micromachined on at least one facial surface of it, multiple distribution flow paths having a flow pattern effective to distribute and combine the plurality of components in the predetermined spatial, non-laminate configuration. The mutually separated components are directed through the multiple distribution flow paths sufficient to distribute and arrange the components to form a fluid structure containing the plurality of components in the predetermined spatial, non-laminate configuration. The fluid structure is then subjected to a non-fiber-forming shaping process in the shaping section to form the molded station from it.

Because of the added costs of necessary hand work in their use, plywood and wood are the least preferred materials of construction. When they are selected as the material of construction, conventional sawing and milling processes are employed.

Although the invention has been described with reference to certain preferred embodiments, it will be appreciated that many variations and modifications may be made within the scope of the broad principles of the invention. Hence, it is intended that the preferred embodiments and all of such variations and modifications be included within the scope and spirit of the invention, as defined by the following claims.

I claim:

1. A generally rectangular planar television channel selection station comprising:

structure for fixing a program schedule guide to said station;

said structure for fixing further comprising:

first, second and third substantially parallel slits, generally parallel to, and substantially adjacent to, a first side of said station; wherein sad first slit is substantially slightly longer in length than the folded side of a program guide schedule and is spaced the nearest of said first, second and third substantially parallel slits, to said first side; and said third slit is spaced the furthest from said first side; and the spacing between said first, second and third substantially parallel slits is sufficient to enable a program schedule guide to be fixed to said station when the last page of the program schedule guide is folded to substantially form a triangle having a base attached to the folded side of the program guide schedule and an apex opposite the folded side, and the triangle is threaded, apex first, through said first slit; then through said third slit; and, finally through said second slit;

structure for attaching a remote control thereto; and, printed indicia for indicating the respective name, call letters and numbers of at least one television station-contiguous to said structure for fixing and said structure for attaching.

2. The station of claim 1, wherein said second slit is wider in the middle thereof, in the direction of said first slit.

3. The station of claim 1, wherein said structure for attaching a remote control thereto, includes a hook and loop-type fastener strip.

4. The station of claim 1, further comprising printed advertisement indicia contiguous to said printed indicia.

5. The station of claim 1, wherein said station is constructed of a material selected from the group consisting of: fiberboard, cardboard, plastic, wood, plywood and combinations thereof.

6. A generally rectangular planar television channel selection station comprising:

structure for fixing a program schedule guide to said station, which includes first, second and third substantially parallel slits, generally parallel to, and substantially adjacent to, a first side of said station wherein said first slit is substantially slightly longer in length than the folded side of a program guide schedule and is spaced the nearest of said first, second and third substantially parallel slits, to said first side; and said third slit is spaced the furthest from said first side; and the spacing between said first, second and third substantially parallel slits is sufficient to enable a program schedule guide to be fixed to said station when the last page of the program schedule guide is folded to substantially form a triangle having a base attached to the folded side of the program guide schedule and an apex opposite the folded side, and the triangle is threaded apex first, through said first slit; then through said third slit; and, finally through said second slit;

structure for attaching a remote control thereto; and, printed indicia for indicating the respective name, call letters and numbers of at least one television station-contiguous to said structure for fixing and said structure for attaching.

7. The station of claim 6, wherein said second slit is wider in the middle thereof, in the direction of said first slit.

8. The station of claim 6, wherein said structure for attaching a remote control thereto, includes a hook and loop-type fastener strip.

9. The station of claim 6, further comprising printed advertisement indicia contiguous to said printed indicia.

10. The station of claim 6, wherein said station is constructed of a material selected from the group consisting of: fiberboard, cardboard, plastic, wood, plywood and combinations thereof.

* * * * *